US008047384B2

(12) United States Patent
Mrowiec

(10) Patent No.: US 8,047,384 B2
(45) Date of Patent: Nov. 1, 2011

(54) MOBILE SIGN RACK AND SIGN STORAGE UNIT

(75) Inventor: John Mrowiec, Winnebago, IL (US)

(73) Assignee: Maverick Enterprises, Inc., Winnebago, IL (US)

( * ) Notice: Subject to any disclaimer, the term of this patent is extended or adjusted under 35 U.S.C. 154(b) by 399 days.

(21) Appl. No.: 12/423,844

(22) Filed: Apr. 15, 2009

(65) Prior Publication Data

US 2009/0255887 A1 Oct. 15, 2009

Related U.S. Application Data

(60) Provisional application No. 61/124,205, filed on Apr. 15, 2008.

(51) Int. Cl.
*A47F 7/18* (2006.01)

(52) U.S. Cl. ..... 211/44

(58) Field of Classification Search ..... 211/44, 211/85.8, 133.2; 280/35, 47.35; 40/591, 40/606.03

See application file for complete search history.

(56) References Cited

U.S. PATENT DOCUMENTS

| | | | | |
|---|---|---|---|---|
| 3,601,256 | A * | 8/1971 | Bowers et al. | 108/108 |
| 4,108,311 | A | 8/1978 | McClendon | |
| 4,189,074 | A * | 2/1980 | Davies | 224/509 |
| 4,262,831 | A | 4/1981 | Buchanan | |
| 4,759,450 | A * | 7/1988 | Ball et al. | 211/50 |
| 4,777,751 | A | 10/1988 | Pasquale | |
| 4,923,202 | A * | 5/1990 | Breveglieri et al. | 280/47.35 |
| 4,978,013 | A * | 12/1990 | Hogg | 211/133.2 |
| 5,016,893 | A * | 5/1991 | Hart, Jr. | 280/35 |
| 5,297,685 | A * | 3/1994 | Ramey | 211/59.4 |
| 5,328,066 | A | 7/1994 | Cappuccio et al. | |
| 5,438,780 | A * | 8/1995 | Winner | 40/514 |
| 5,465,883 | A * | 11/1995 | Woodward | 224/495 |
| 5,800,294 | A * | 9/1998 | Naecker, Jr. | 473/481 |
| 6,374,524 | B1 | 4/2002 | Capps | |
| 6,644,484 | B1 * | 11/2003 | Sardis | 211/190 |
| 6,845,894 | B1 | 1/2005 | Vyvoda | |
| 2005/0252053 | A1 * | 11/2005 | Pena | 40/591 |
| 2006/0053667 | A1 * | 3/2006 | Andersen | 40/591 |
| 2006/0201038 | A1 * | 9/2006 | Haubert | 40/591 |
| 2008/0011698 | A1 * | 1/2008 | Simon | 211/85.8 |
| 2008/0149787 | A1 * | 6/2008 | Cole | 248/126 |
| 2009/0096236 | A1 * | 4/2009 | Hawley | 296/3 |
| 2009/0255887 | A1 * | 10/2009 | Mrowiec | 211/85.8 |
| 2010/0109287 | A1 * | 5/2010 | MacDougall | 280/491.1 |
| 2010/0187794 | A1 * | 7/2010 | MacDougall | 280/491.3 |
| 2010/0251584 | A1 * | 10/2010 | Bey et al. | 40/606.03 |

FOREIGN PATENT DOCUMENTS

| | | |
|---|---|---|
| FR | 2845101 | 4/2004 |

* cited by examiner

*Primary Examiner* — Sarah Purol
(74) *Attorney, Agent, or Firm* — Charles S. Sara, Esq.; DeWitt Ross & Stevens, S.C.

(57) ABSTRACT

A mobile sign rack which can be easily and quickly mounted or disconnected from the tailgate of a truck for the purpose of storing and/or transporting signs, sign stands, traffic cones and stop and slow paddles to secure worksites on the roadway.

19 Claims, 12 Drawing Sheets

MOBILE SIGN RACK AND SIGN STORAGE UNIT

REFERENCE TO RELATED APPLICATION

The application claims priority to U.S. Provisional Application entitled "HIGHWAY SIGN RACK," Ser. No. 61/124,205, filed Apr. 15, 2008, which is incorporated herein by reference in its entirety.

FIELD OF THE INVENTION

The present invention is directed to storage racks that can be mounted on trucks and portable traffic sign storage units. This invention is specifically directed to a mobile sign attachment for a highway construction vehicle, which holds signs, tripods, cones, etc., for accessibility to highway employees and which can be used as a storage unit when not attached to vehicle.

DESCRIPTION OF THE PRIOR ART

State and federal law mandate the use of traffic control devices such as signs, etc. The problem with the system currently in use is that these signage devices are stored separately and randomly and are transported in the back of trucks where they are not easily accessible and due to this fact can cause delayed response, damage to equipment or injuries to personnel. Also due to the unavailability of these necessary traffic control devices because of the inconvenience of finding the proper signage materials and loading and unloading them, some work crews unlawfully work without all the necessary signage at the worksite. This, in turn, endangers the health and life of the worker and the motoring public along with the creating liability to the appropriate agency.

The prior art includes some systems for storing and transporting signs and the like. For example, U.S. Pat. No. 5,328,066 to Cappuccio is directed to a cart for use in transporting cones, flags and illuminated signals. The cart is designed so that it can be removably mounted to the front of a utility truck. The cart incorporates two horizontally aligned wheels at its base and several support panels designed to carry traffic cones or other highway-related items. When not attached to a vehicle, the cart can be tilted so that its entire weight is supported by the wheels and rolled to various locations within a work site. Finally, the patent indicates that traffic signs can be attached to the cart to signal drivers of altered road conditions. However, this patent does not disclose any additional features which could contain rolled-up signs.

U.S. Pat. No. 4,262,831 to Buchanan is directed to a traffic cone rack designed to be fixedly mounted to the bumper of a vehicle. The invention includes a flat body portion designed to be attached to a bumper. A cone support is attached to the body portion and is shaped to hold and support traffic cones. The body portion and the cone support are both secured to the bumper. In use, traffic cones are placed over the cone support and can be transported via a vehicle. The invention also discloses a locking hinge mechanism which keeps cones on the rack during transport. The patent does not suggest or describe any feature to hold large signs.

U.S. Pat. No. 6,845,894 to Vyvoda is directed to a utility rack designed for transporting flat objects on the side of a standard pick-up truck. Using hooks, the rack hangs from a scaffolding or pipe-rack set up in the bed of the truck. The rack then rests against the wall of the truck bed. The rack's depth, length, and width can be adjusted to incorporate generally flat objects of varying sizes. This invention seems to be a typical plate-glass carrier for a pick-up truck. This invention does not disclose the use of shelves or tubes for storing large or folded road signs.

U.S. Pat. No. 4,108,311 to McClendon is directed to a portable container, which stores a number of rolled-up safety warning signs. The invention also includes a display pole stored within the container. The container includes a hole in the center, through which the display pole is inserted. The safety warning signs can be unrolled and hung from the pole and set up next to a vehicle, thereby converting the container to a base for displaying the sign. Although the patent discloses rolled up signs and a method for storing them, there is no suggestion of a way to attach the container to a vehicle.

French patent application 2,845,101 to Taglione is directed to a portable trailer with vertical racks to organize rigid traffic signs, storage zones for pedestrian pedestals, and a set of wheels that allow the trailer to be pulled by a vehicle. The vertical racks are designed with several parallel rods to store flat traffic signs in an upright position. The set of wheels are horizontally aligned and located at the center of the base of the trailer. The trailer includes a typical trailer hitch so the entire unit can be attached to a vehicle and towed.

SUMMARY OF THE INVENTION

The present invention involves a sign rack that can be easily and quickly mounted or disconnected from the tailgate of a 1 ton, 3 ton or tandem dump truck for the purpose of storing and/or transporting signs, sign stands, traffic cones and stop and slow paddles to secure worksites on the roadway. The device is an all-in-one container for holding highway signs. It allows highway workers to easily remove the signs for placement on the roads and to store the signs. At the end of the day, the sign rack can be taken to the storage yard and unloaded. When it is needed, it can be reloaded onto the truck. In this manner, construction workers do not need to keep looking for signs in the yard as they are all organized in one place.

It is the object of this invention to provide a working platform for the storage and transportation of the signage mandated at a roadway worksite. This can in turn allow one person to attach the sign rack to the truck, drive to the worksite and erect the necessary signs on the roadway, greatly increasing response time and decreasing manpower.

The present invention is an all-in-one container for roll-up and sheet metal traffic signs and traffic cones. The invention includes a large rack, which can be removably attached to a vehicle for transportation to and from work sites. The rack also incorporates two horizontally aligned wheels, which roll the sign away from the truck when the dump box is raised. Other elements include various methods and structures for holding and storing different sizes and shapes of signs.

The present invention is directed to a mobile sign rack that can be easily and quickly mounted or disconnected from the tailgate of a vehicle for the purpose of storing and/or transporting signs, sign stands, traffic cones and stop and slow paddles to secure worksites on the roadway. The mobile sign rack comprises a substantially vertical frame attached to a base, wherein the vertical frame comprises an interior section for maintaining signage; at least one mounting clip for mounting the mobile sign rack to the vehicle; at least one bumper assembly positioned on the frame for positioning the mobile sign rack on the vehicle, the at least one bumper assembly comprising means to maintain the mobile sign rack in a substantially vertically oriented position; a mounting tray attached to the base for storing traffic cones and other necessities; and at least one pair of wheels on the rack to assist the mobility of the mobile sign rack when the mobile sign rack is positioned on a ground surface.

The present invention is further directed to a mobile sign rack comprising a substantially vertical frame attached to a base, wherein the vertical frame includes two front and two rear parallel disposed uprights, wherein the uprights are connected at the upper end by a pair of parallel disposed crossbars and a pair of horizontal stabilization bars, wherein the frame further includes an interior section for maintaining signage, wherein the interior section comprises at least one generally cylindrical tubular sign holder for storing flexible signage, wherein the generally cylindrical tubular sign holder includes a removable cap for accessing the interior of the sign holder; at least one mounting clip for mounting the mobile sign rack to the vehicle; at least one bumper assembly positioned on the frame for positioning the mobile sign rack on the vehicle, the at least one bumper assembly comprising means to maintain the mobile sign rack in a substantially vertically oriented position; a mounting tray attached to the base for storing traffic cones and other necessities, wherein the mounting tray includes a spacer bar and a foraminous floor; a pair of leveling legs on the frame for positioning the mobile sign rack in a substantially level position when the mobile sign rack on a ground surface; and at least one pair of wheels on the rack to assist the mobility of the mobile sign rack when the mobile sign rack is positioned on a ground surface.

The present invention is further directed to a mobile sign rack comprising a substantially vertical frame attached to a base, wherein the vertical frame includes two front and two rear parallel disposed uprights, wherein the uprights are connected at the upper end by a pair of parallel disposed crossbars and a pair of horizontal stabilization bars, wherein the frame further includes an interior section for maintaining signage, wherein the interior section comprises at least one track for holding inflexible signage; at least one mounting clip for mounting the mobile sign rack to the vehicle; at least one bumper assembly positioned on the frame for positioning the mobile sign rack on the vehicle, the at least one bumper assembly comprising means to maintain the mobile sign rack in a substantially vertically oriented position; a mounting tray attached to the base for storing traffic cones and other necessities, wherein the mounting tray includes a spacer bar and a foraminous floor; a pair of leveling legs on the frame for positioning the mobile sign rack in a substantially level position when the mobile sign rack on a ground surface; at least one pair of wheels on the mobile sign rack to assist the mobility of the mobile sign rack when the mobile sign rack is positioned on a ground surface; and brackets for holding traffic paddles.

Advantageously, the sign rack of the present invention is easy to install onto a vehicle, such as a construction or dump truck. It can be attached to the back of a truck in approximately 30 seconds. Further the sign rack of the present invention can be adjusted to fit a variety of sizes of vehicles.

When the sign rack is not in use it can serve as a storage rack for the signage equipment on a lot or the like. Thus, the sign rack can be easily uninstalled from the vehicle and placed on the ground or in a storage structure without the need to remove any signage equipment. Therefore, the signage equipment remains in one place ready for the next use. This cuts down on labor cost, wear and tear on equipment and reduces the chance of injury to workers.

Further, the sign rack of the present invention makes the requirement for using signage easier, faster and safer. The sign rack keeps the signage organized and protected and allows easier setups and removals of signs as the signage equipments is easier to reach and does not require climbing into the back of a truck to locate equipment.

Further, the sign rack is designed to makes setup and takedown of signs safer and easier. The sign rack is designed so the highway worker is unloading and loading signage equipment on the shoulder side of the road. This eliminates the need for the worker to be in traffic while setting up temporary signage. Further still, the sign rack can be operated by one person, thus cutting down on labor cost. The sign rack typically puts all the signage equipment at waist height which eliminates much of the bending over and lifting out position, and thus reduces injury.

Further the sign rack protects the signs and equipment, therefore reducing the wear and tear of signs and sign accessories.

The objects and advantages of the invention will appear more fully from the following detailed description of the preferred embodiment of the invention made in conjunction with the accompanying drawings.

DETAILED DESCRIPTION OF THE INVENTION

Figure 1:
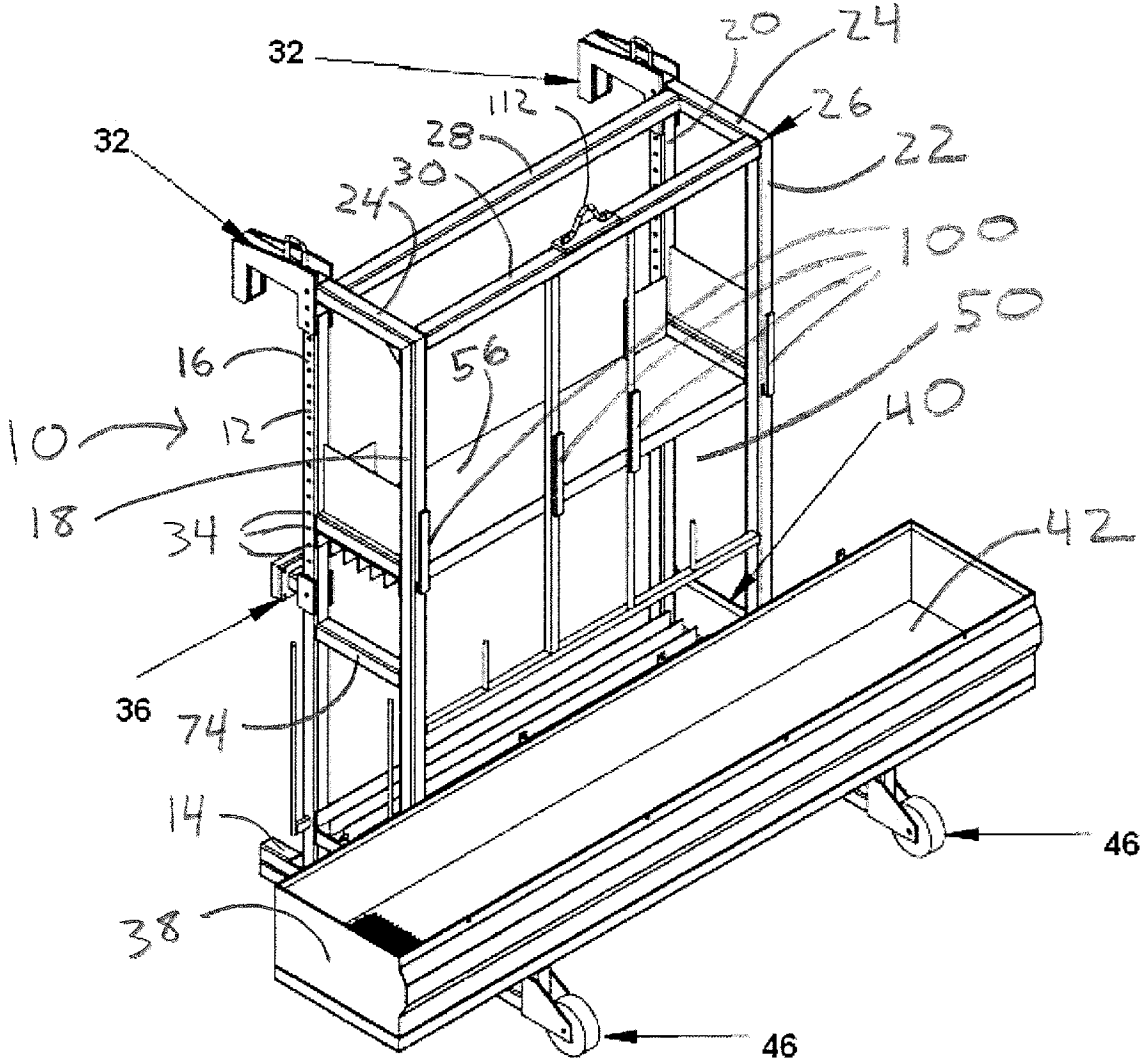
FIG. 1 is a perspective view of the mobile sign rack of the present invention.

Referring to the FIG. 1, the mobile sign rack 10 is constructed of a vertically oriented frame 12 attached to a base 14. Preferably, the frame 12 and base 14 are constructed of steel and most preferably two inch tubular steel. The frame 12 includes four uprights 16, 18, 20 and 22. Uprights 16 and 18 are connected at the upper end by a crossbar 24. Likewise, uprights 20 and 22 are connected by crossbar 24. To add further support, the combination of uprights 16 and 18 and crossbar 24 are connected to uprights 20, 22 and crossbar 26 by horizontal stabilization bars 28 and 30. This gives frame 12 a rectangular box configuration. As illustrated best in FIGS. 1, 3, 4 and 5, the uprights 16 and 20 each include mounting clips 32 for mounting the entire rack onto the back of a truck. As further illustrated in FIGS. 1, 4 and 5, uprights 16 and 20 include openings 34 to allow for adjustment of the mounting clips 32 along the length of the uprights 16 and 20. In addition, the uprights 16 and 20 include a bumper assembly 36 (FIGS. 1 and 10) of rubber or other shock absorbing material which is also adjustable along the openings 34 for positioning the rack 10 on the back of a truck and maintaining the rack 10 in a vertically oriented position.

The base 14 is a generally rectangular structure, the dimensions of which can be sized and shaped depending upon the type of vehicle carrying the mobile sign rack 10 and the needs based on the size of the job. Without being limited to any specific size dimensions, a base structure can be typically sized between 36 inch by 36 inch and 48 inch by 48 inch. The measurement depends on a variety of factors including: tailgate thickness, tailgate height from level pavement, tailgate height once dump box is completely raised from level pavement.

Figure 2:
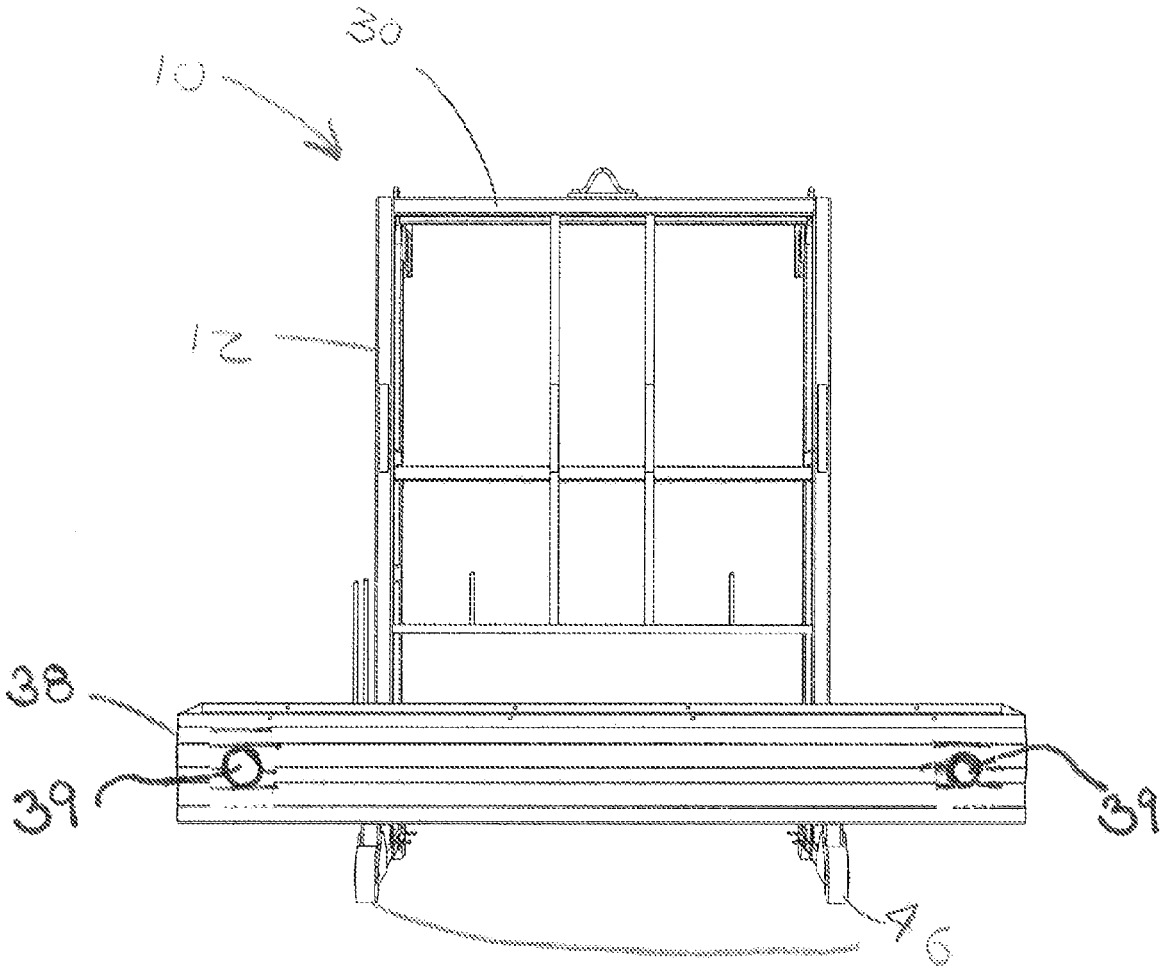
FIG. 2 is a front elevated view of the mobile sign rack of FIG. 1.

The base 14 serves the purposes of mounting the frame 12, mobilizing the rack 10 when the rack 10 is located on a ground surface and securing an optional mounting tray 38. The mounting tray 38 is a utility box structure designed for storing traffic cones and other necessities. As illustrated in FIG. 2, the mounting tray 38 can include safety tail lights or directional lights, generally indicated at 39.

Figure 4:
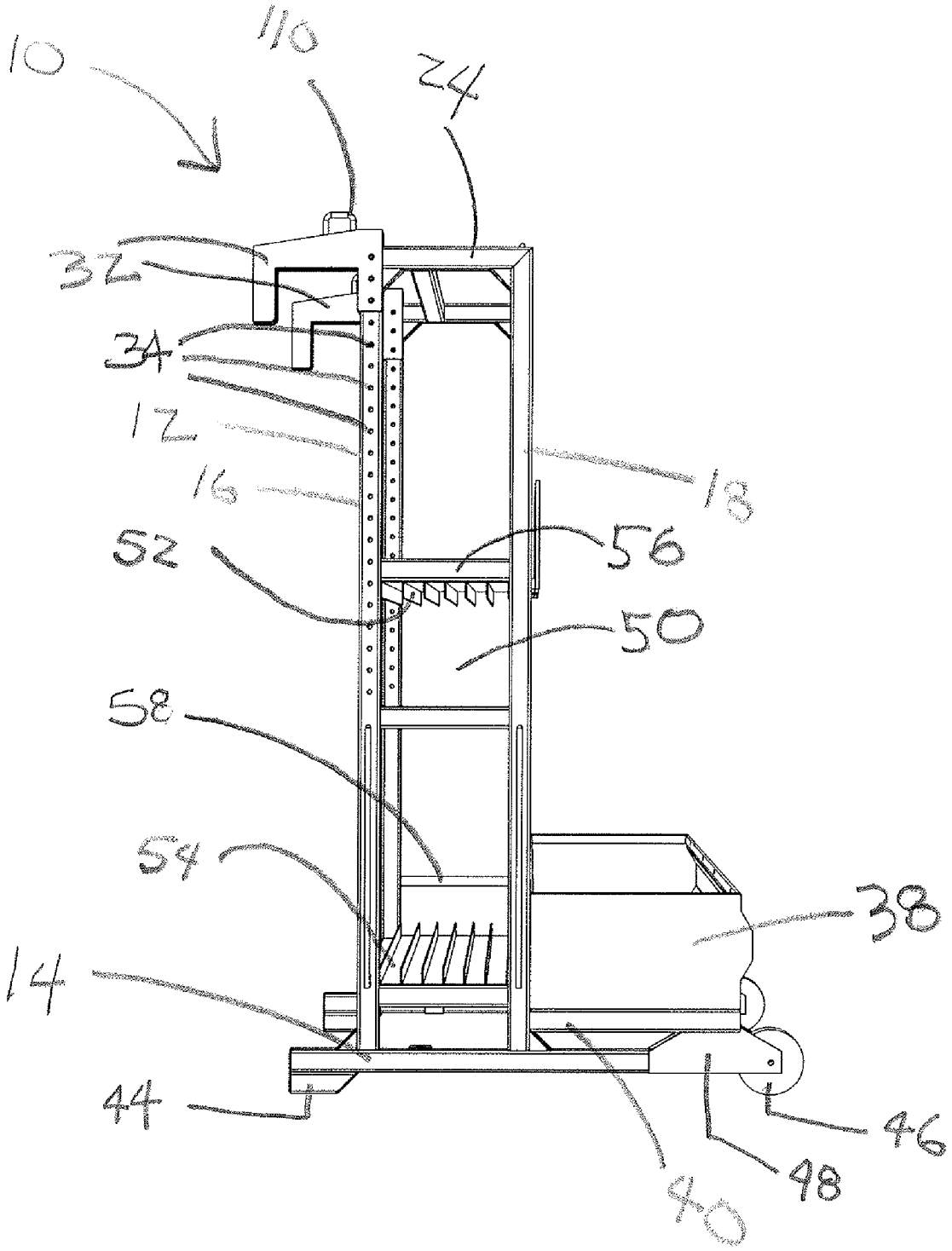
FIG. 4 is a first side view of the sign rack of FIG. 1.
Figure 6:
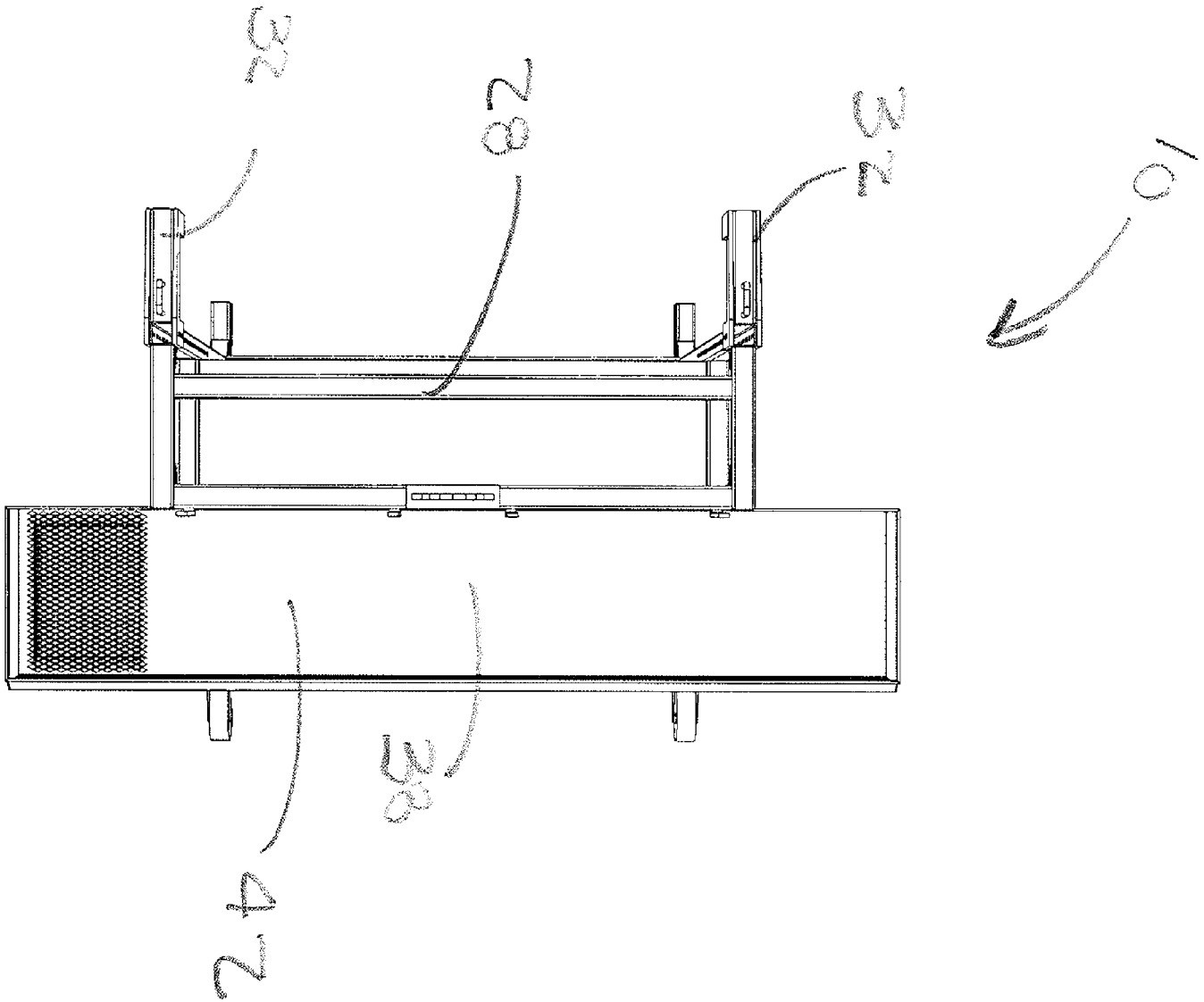
FIG. 6 is a top elevated view of the sign rack of FIG. 1.
Figure 7:
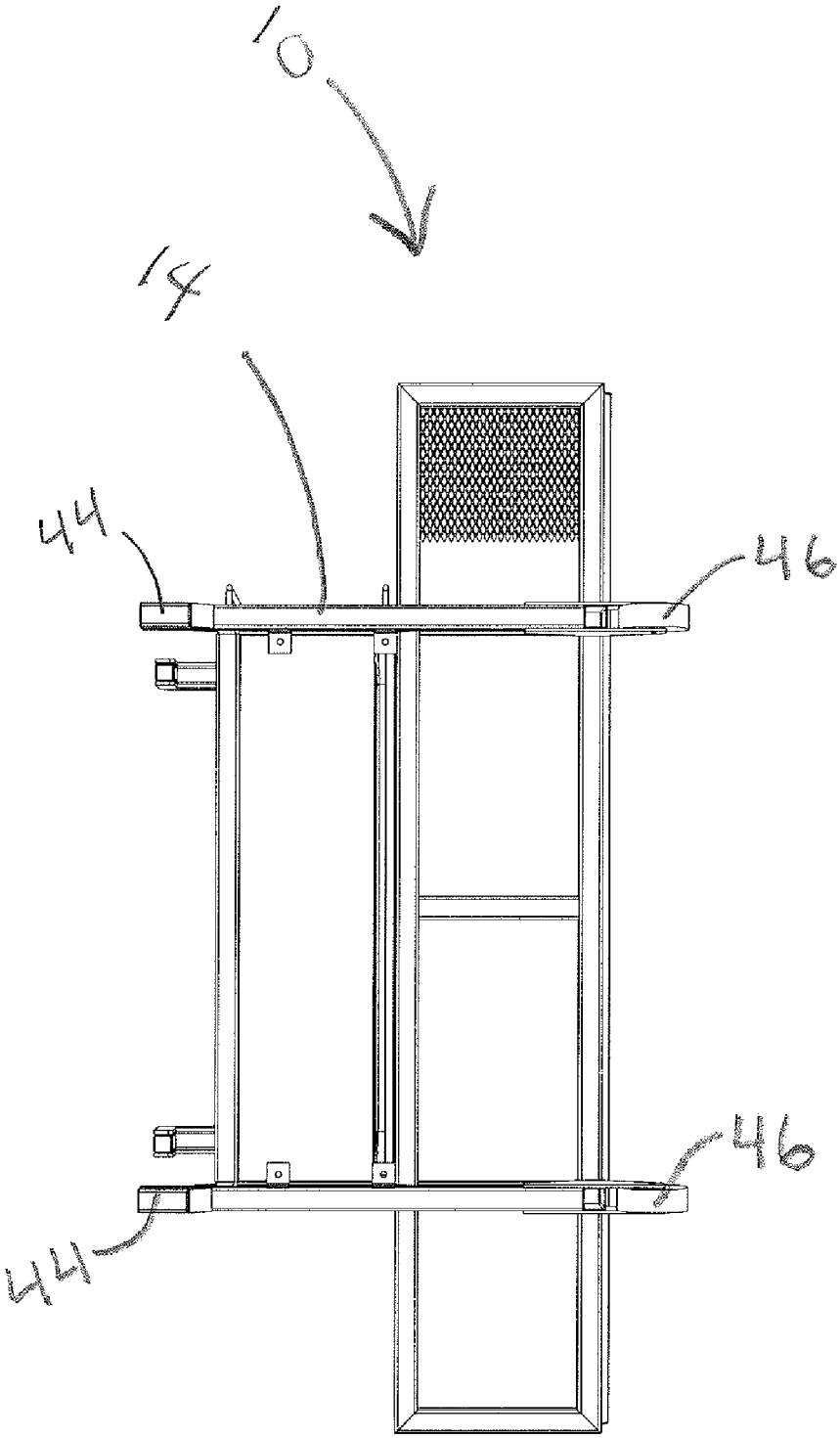
FIG. 7 is a bottom elevated view of the sign rack of FIG. 1.

Referring to FIGS. 4 and 6, the mounting tray 38 preferably includes a spacer bar 40 and an expanded floor 42 to the tray 38. Preferably, the floor 42 is foraminous in order to allow water and other liquids to flow through.

Figure 3:
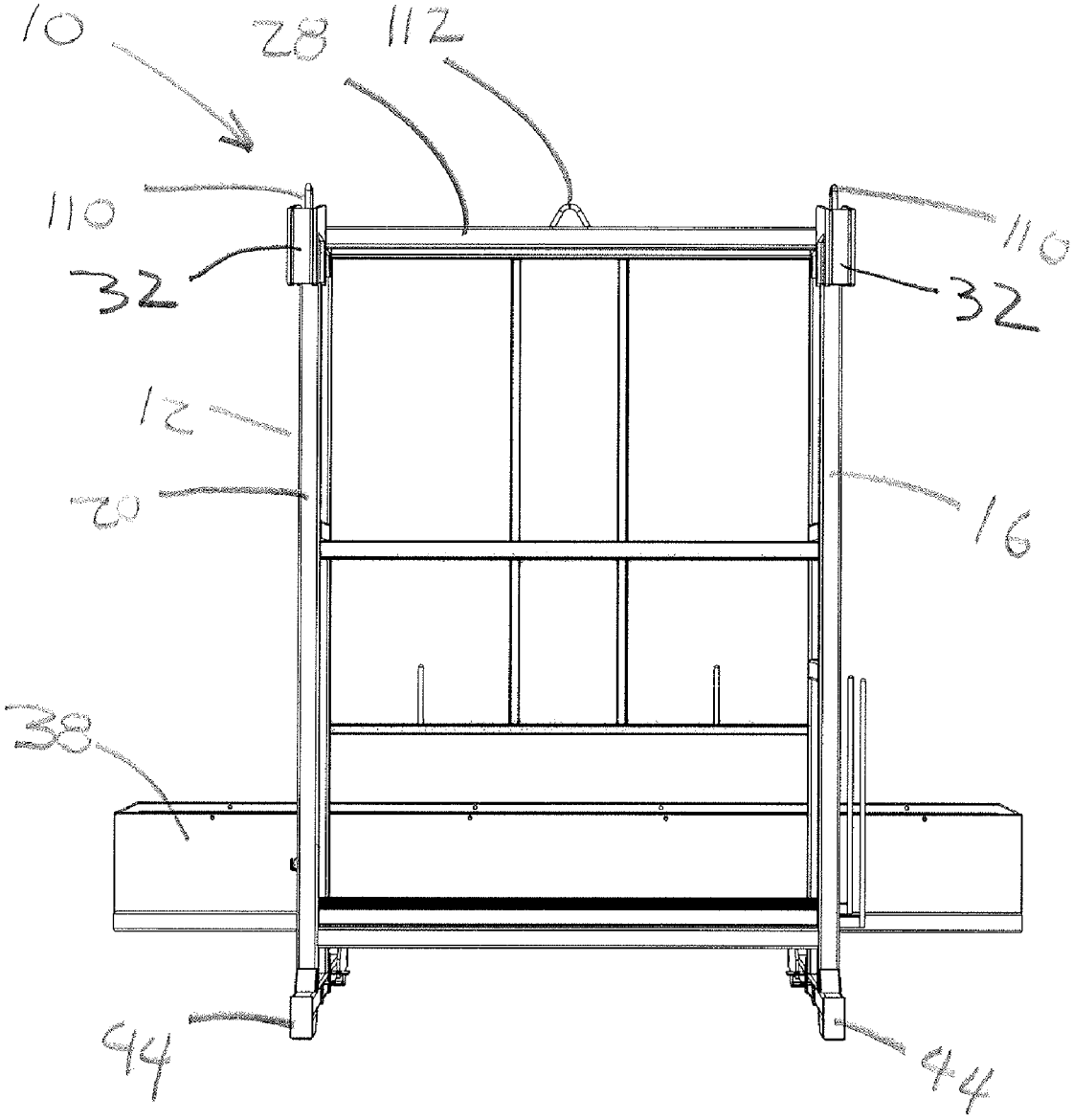
FIG. 3 is a rear elevated view of the mobile sign rack of FIG. 1.
Figure 5:
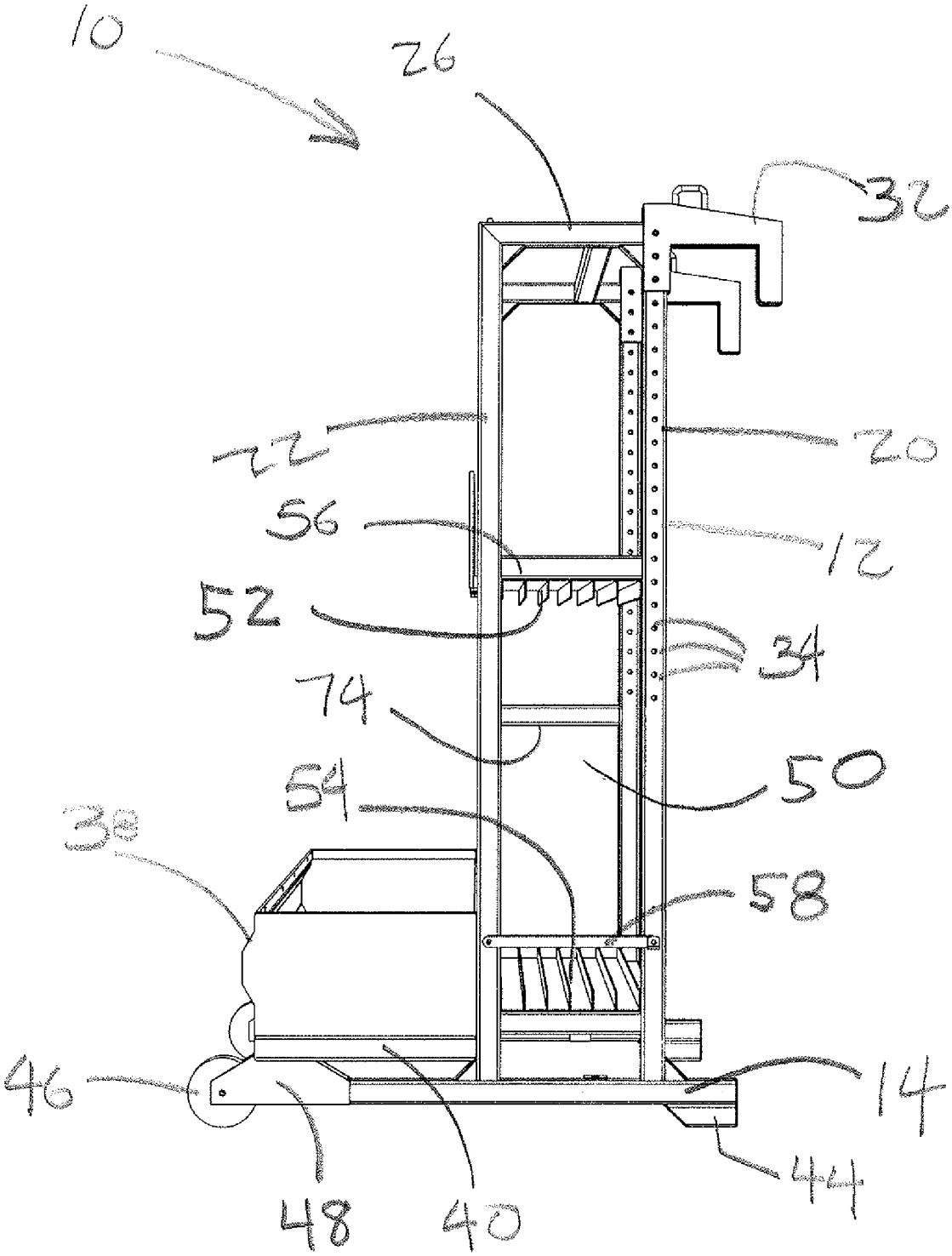
FIG. 5 is a second side view of the sign rack of FIG. 1.

Located at the end closest to the truck when the rack 10 is mounted are two leveling legs 44, illustrated in FIGS. 3, 4 and 5, on either side of the rack 10. Located at the other end of the frame 14 are two wheels 46 to assist the mobility of the rack 10. The wheels 46 are kept in place by a wheel bracket 48.

With reference now to FIGS. 1-7, the frame 12 includes an interior section 50 defined by uprights 16, 18, 20 and 22, crossbars 24 and 26, and horizontal stabilization bars 28 and 30. As shown in FIGS. 1-7, the interior section 50 is designed to hold hardboard large flat signage (not shown). With reference specifically to FIGS. 4 and 5, the interior section 50 is defined by upper and lower tracks 52 and 54 for providing a stall to receive the signage. While the lower tracks 54 are fixed to the base 14 of the frame 12, the upper tracks 52 may be adjustable along the length of the frame 12 to accommodate signage of varying dimensions by moving the upper platform 56 of the upper tracks 52 along the uprights 16, 18, 20, and 22 and securing the platform to the uprights by bolts through the openings 34 or other means known to the art. A rotating securing bar 58 may be placed at either or both ends of the frame 12 to prevent loss of the signage as the rack 10 is being moved.

Figure 8:
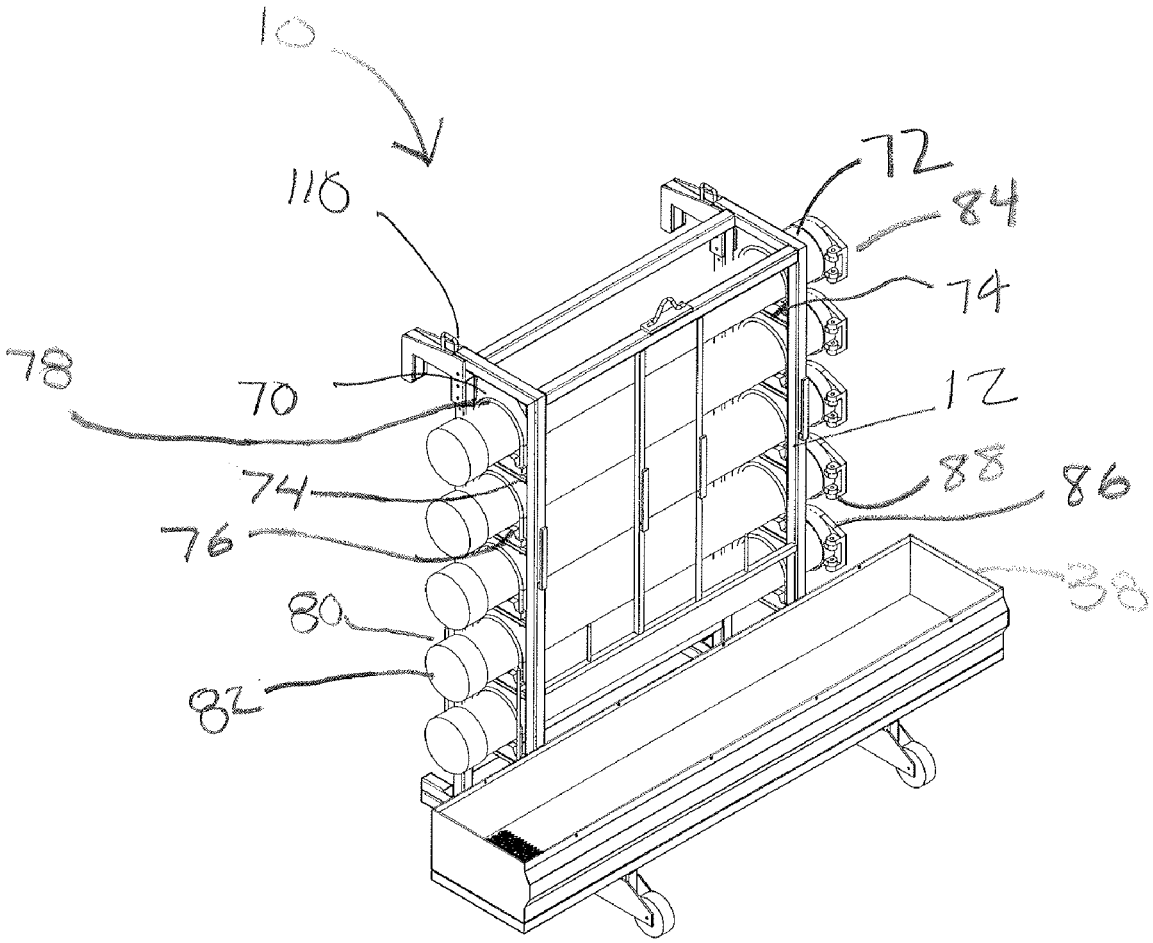
FIG. 8 is a perspective view of an alternative embodiment of the mobile sign rack of the present invention.
Figure 9:
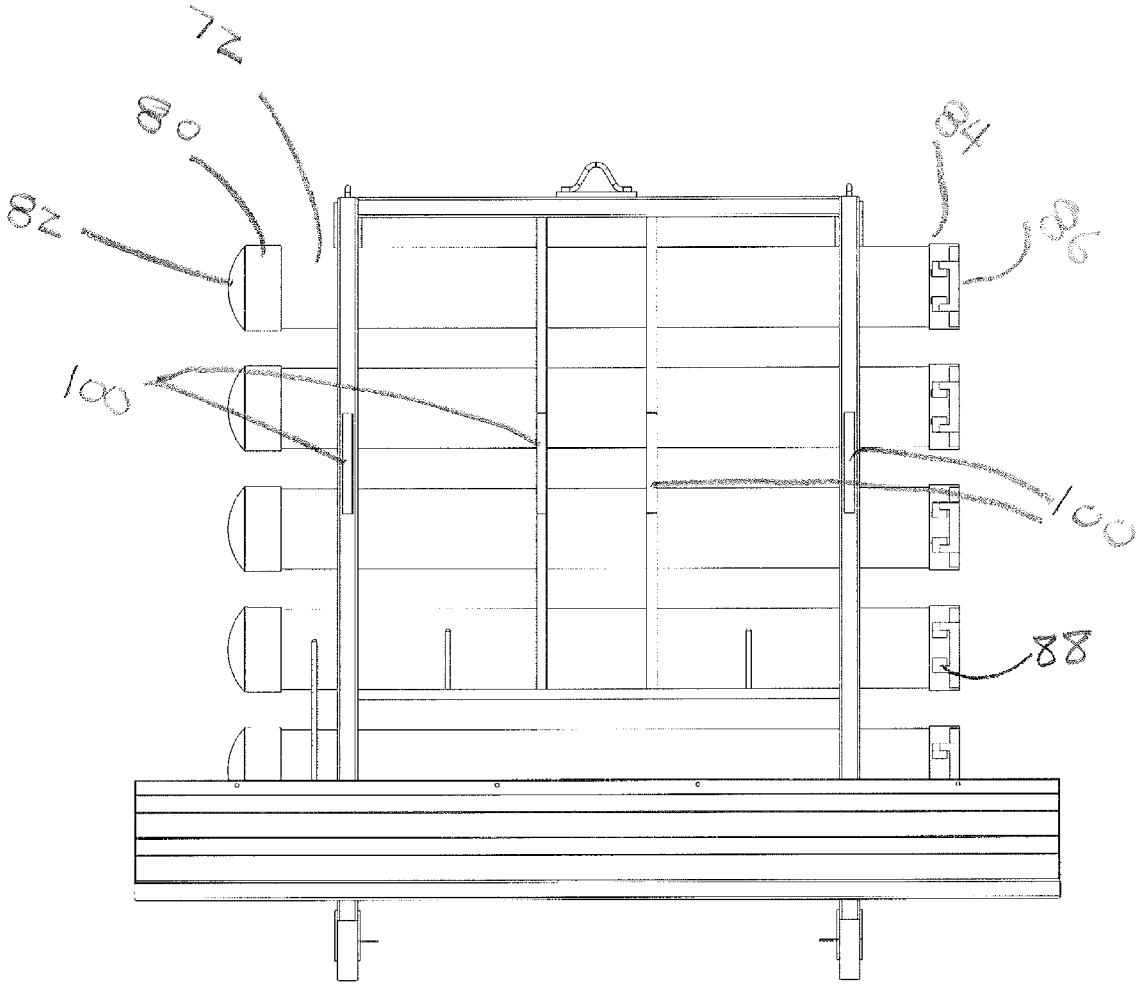
FIG. 9 is a front elevated view of the mobile sign rack of FIG. 8.

Reference is now made to FIGS. 8 and 9 for an alternative embodiment of the rack 10 in which the interior section 50 of the frame 12 is subdivided into sections 70 for holding generally cylindrical tubular sign holders 72. The sign holders 72 are intended to hold flexible signs which can be rolled up and stored within the sign holders 72. As illustrated in FIGS. 8 and 9, there are five sections 70 although it is within the skill of the art to have more or fewer sections 70 depending on the particular circumstances. In addition, it is within the skill of the art to combine the features of FIGS. 1-7 with FIGS. 8 and 9 to have a rack 10 which includes both tracks 52, 54 for hard signage and tubular sign holders 72 for flexible or rolled signage.

Each sign holder 72 is maintained within the frame 12 by a pair of cross support brackets 74 which are mounted to the uprights 16, 18, 20 and 22. Situated atop each cross support bracket 74 are cradle brackets 76 generally made of PVC plastic or other similar materials. The sign holders 72 are then fixed to the cradle brackets 76 by a U-bolt 78, generally of a stainless steel or similar configuration. The sign holder 72 is closed at one end 80 by means of a permanently affixed cap 82 or similar device. Situated at the other end 84 is a hinged or removable cap 86 which is designed to be easily opened by a latch or other mechanism for placement or removal of the flexible signage. As illustrated in FIGS. 8 and 9, the removable cap 86 is attached to the sign holder 72 by means of a hinge 88.

Referring now to FIGS. 1-9 and optionally positioned on the uprights 16, 18 or 20, 22 are stop and slow paddle handle brackets 100 for holding traffic paddles which generally have the words "STOP" or "SLOW".

In addition, the upper portion of the frame 12 includes a safety chain holder 110 on the mounting clip 32 for threading a chain or other safety wire to further secure the rack 10 to a vehicle. Optionally, there is a catch 112 to further assist the movement of the rack 10 onto or off of a vehicle.

As a typical load for a mobile sign rack 10, the sign rack 10 can include the following:

24 temporary road construction signs;

2 stop and slow paddles;

2 stop and slow paddles extensions;

Storage tray that is 18 inches wide×92 inches long×10 inches deep, to be able to store any type of temporary sign bases and traffic cones; and Up to 10 traffic cones with cone bracket.

Of course, the numbers and types of signage equipment can change depending on the size and structure of the mobile sign rack 10.

Figure 10:
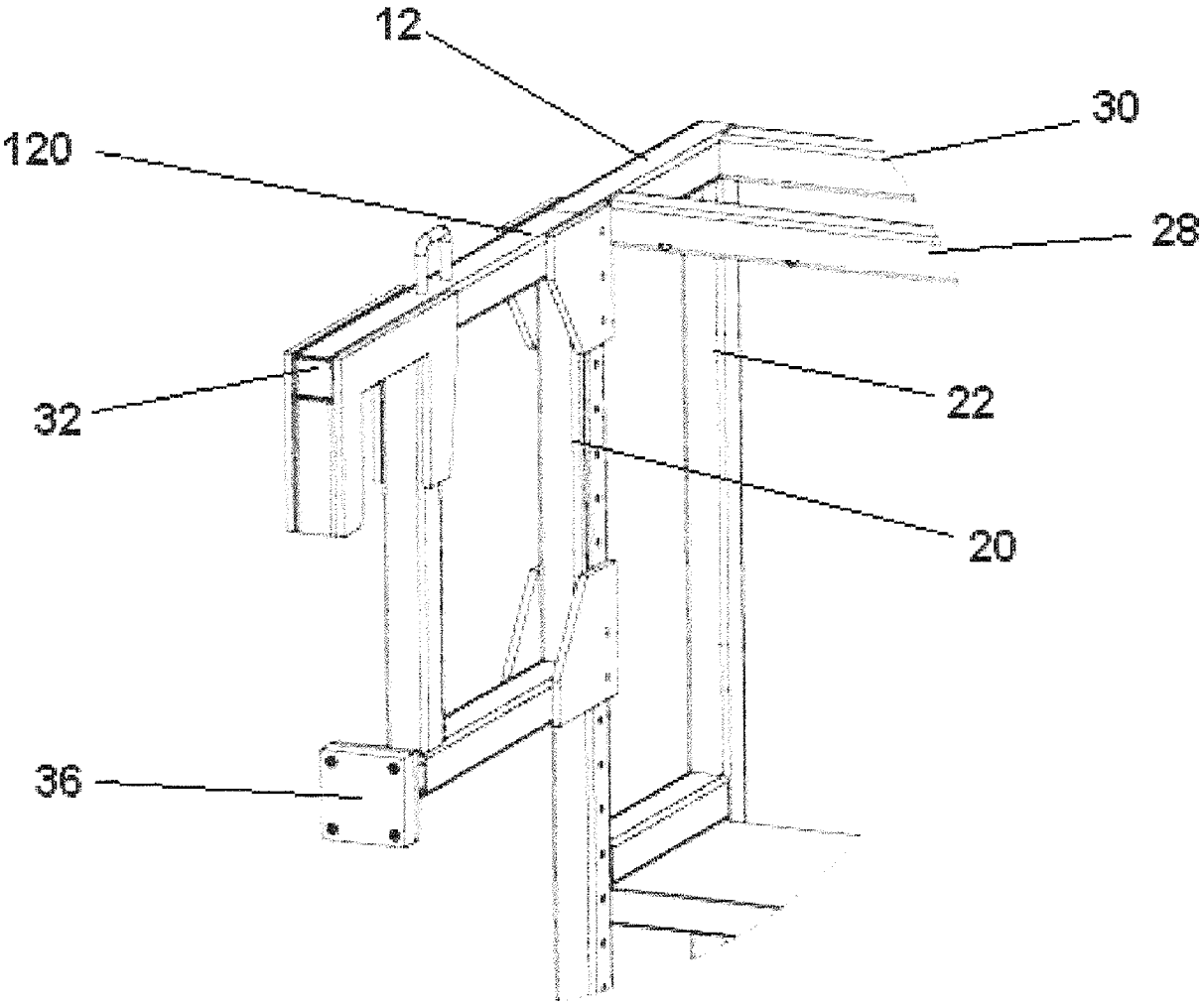
FIG. 10 is partial perspective view of the mobile sign rack illustrating another embodiment thereof.

Referring now to FIG. 10, the mobile sign rack 10 can include a spreader off-set assembly 120 for placing a distance brace between the frame 12 of the rack 10 and the mounting clips 32. The purpose of the spreader off-set assembly 120 is to off-set the mobile sign rack 10 a distance of one or two feet from the vehicle to accommodate certain features in the vehicle such as, for example, a salt spreader.

Mounting the Mobile Sign Rack 10 to the Vehicle 150

Figure 11:
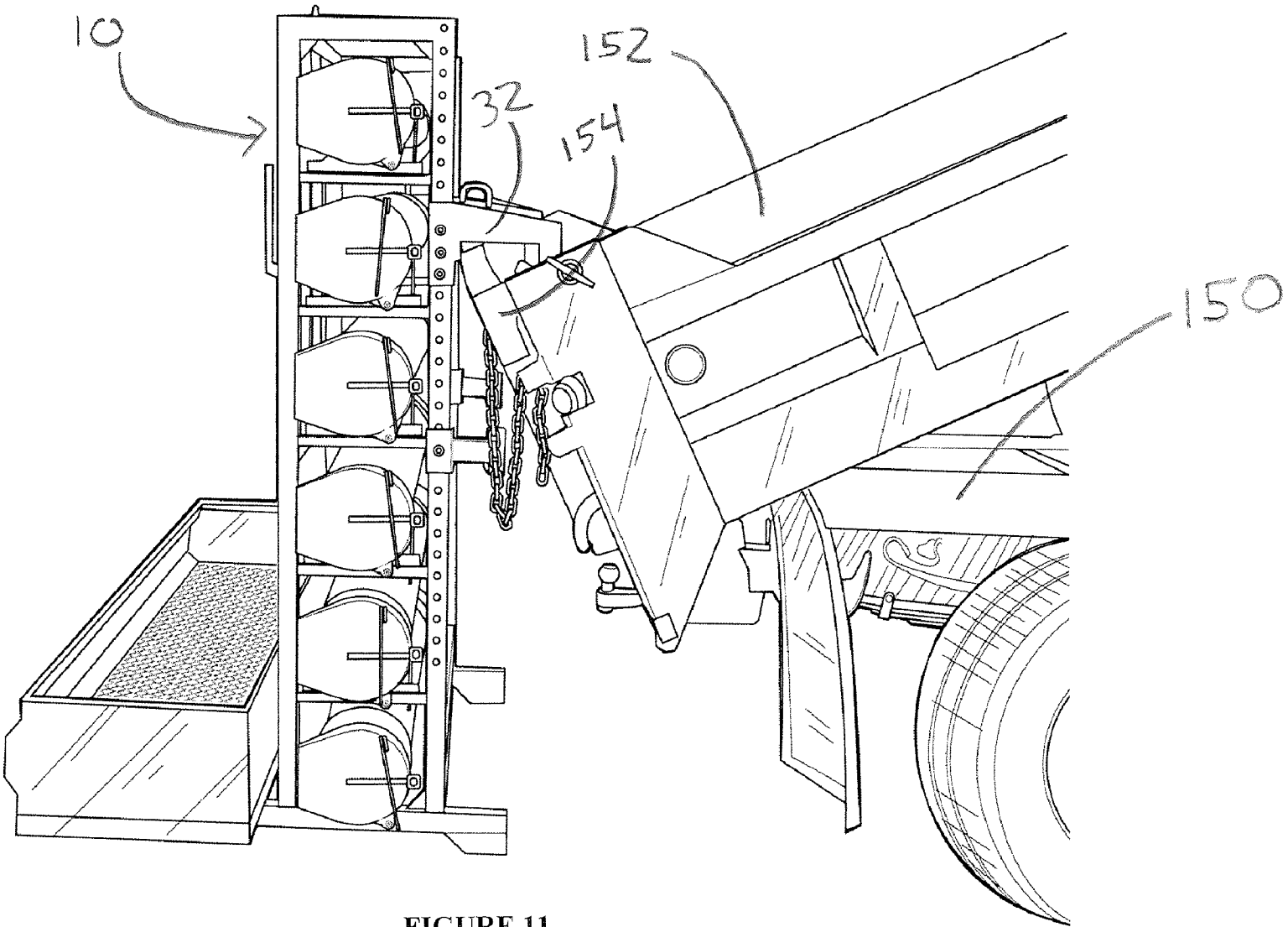
FIG. 11 is side view of the mobile sign rack of the present invention as it is about to be attached to a vehicle.
Figure 12:
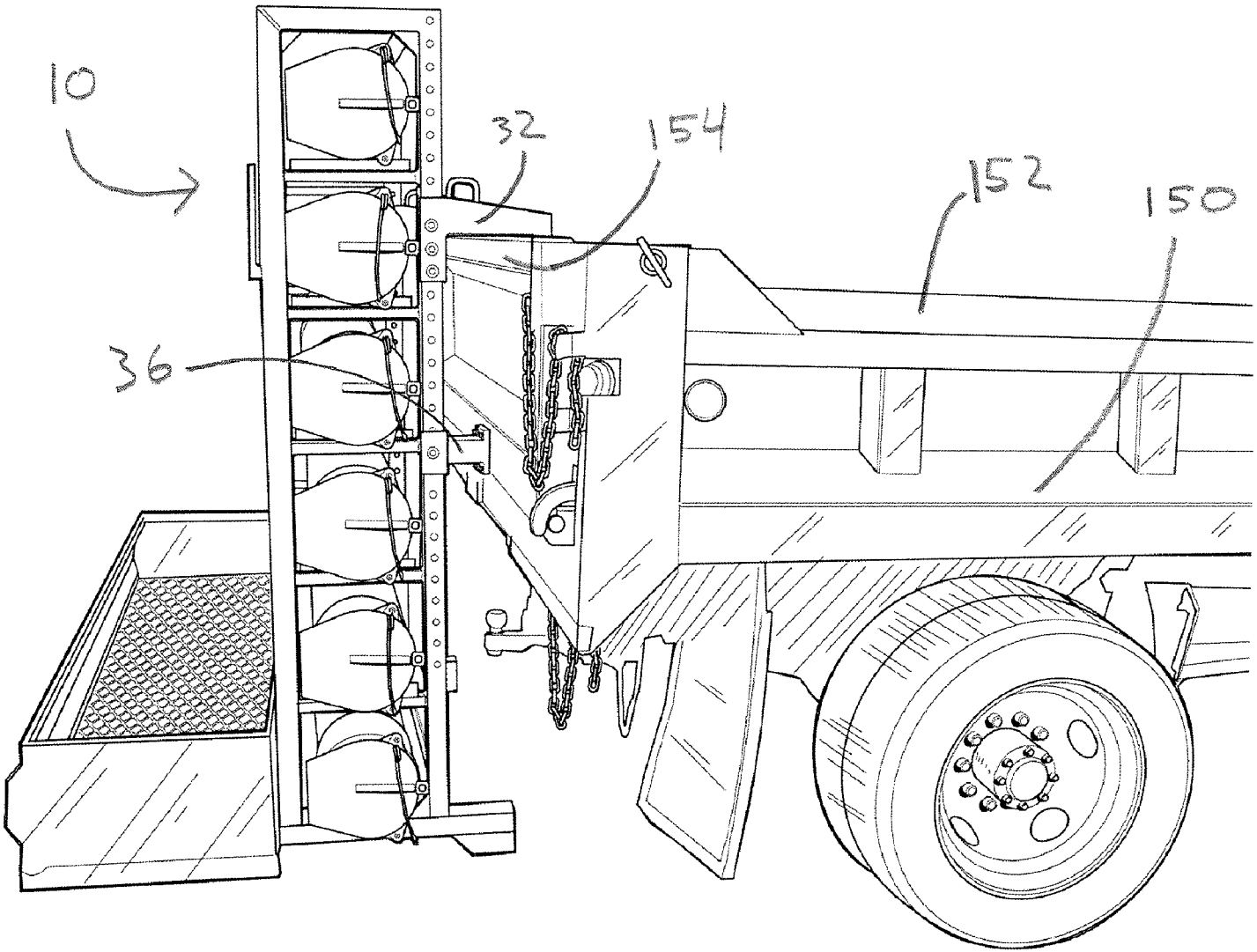
FIG. 12 is a side elevated view of the mobile sign rack of the present invention attached to a vehicle.

Referring now to FIGS. 11 and 12, the mobile sign rack 10 is mounted onto a vehicle 150, such as a truck or the like by raising the truck box 152 of the vehicle 150 to its elevated position as illustrated in FIG. 11, backing the vehicle 150 under the mounting clips 32 of the sign rack 10 then lowering the truck box 152 to the lowest position, as illustrated in FIG. 12. This allows the sign rack 10 to clip over the tailgate 154 of the vehicle 150 and rest in an upright position. The mobile sign rack is kept in a relatively vertical position on the vehicle 150 by means of the bumper assemblies 36 resting against the tailgate 154 of the vehicle 150. The mobile sign rack is then secured to the truck box 152 by a safety chain and chain binder (not shown).

Preferably, the mobile sign rack 10 of the present invention is designed so all signage is removed from the passenger side of the vehicle on the shoulder away from the danger of traffic.

Disconnecting the Mobile Sign Rack 10 from the Vehicle 150

After all signage is erected at the worksite, the mobile sign rack 10 may be easily disconnected by reversing the installation sequence thus allowing the sign rack wheels 46 to move the sign rack 10 away from the vehicle 150 as the dump box 152 is raised allowing the vehicle 150 to be used at the worksite without the mobile sign rack 10 in tow. After work has been completed, the mobile sign rack 10 can be remounted on the vehicle 150, then reloaded with signage and taken back to the work station. The mobile sign rack 10 can be disconnected and become a storage unit. This will ensure that all signage is readily accessible for the next assignment.

It is understood that the invention is not confined to the particular construction and arrangement of parts herein illustrated and described, but embraces such modified forms thereof as come within the scope of the following claims.

What is claimed is:

1. A mobile sign rack that can be easily and quickly mounted or disconnected from the tailgate of a vehicle for the purpose of storing and/or transporting signs, sign stands, traffic cones and stop and slow paddles to secure worksites on the roadway, comprising:

a. a substantially vertical frame attached to a base, wherein the vertical frame comprises an interior section for maintaining signage;

b. at least one mounting clip for mounting the mobile sign rack to the vehicle;

c. at least one bumper assembly positioned on the frame for positioning the mobile sign rack on the vehicle, the at least one bumper assembly comprising means to maintain the mobile sign rack in a substantially vertically oriented position;

d. a mounting tray attached to the base for storing traffic cones and other necessities and;

e. at least one pair of wheels on the rack to assist the mobility of the mobile sign rack when the mobile sign rack is positioned on a ground surface.

2. The mobile sign rack of claim 1 wherein the vertical frame includes two rear and two front substantially parallel uprights, wherein the uprights are connected at the upper end by parallel disposed crossbars and horizontal stabilization bars.

3. The mobile sign rack of claim 2 wherein the rear uprights include openings to adjustably attach the mounting clip along the length of the rear uprights.

4. The mobile sign rack of claim 2 wherein the position of the bumper assembly is adjustable along the frame by means of the openings in the rear uprights.

5. The mobile sign rack of claim 1 wherein the mounting tray includes a spacer bar and a floor.

6. The mobile sign rack of claim 5 wherein the floor is foraminous.

7. The mobile sign rack of claim 1 further comprising a pair of leveling legs on the frame for positioning the mobile sign rack in a substantially level position when the mobile sign rack on a ground surface.

8. The mobile sign rack of claim 1 wherein the interior section comprises at least one sign holder for holding signage.

9. The mobile sign rack of claim 8 wherein the sign holder is a generally cylindrical tubular sign holder for storing flexible signage.

10. The mobile sign rack of claim 9 wherein the generally cylindrical tubular sign holder includes a removable cap 60 for accessing the interior of the sign holder.

11. The mobile sign rack of claim 8 wherein the sign holder comprises at least one track for holding inflexible signage.

12. The mobile sign rack of claim 1 further comprising brackets for holding traffic paddles.

13. The mobile sign rack of claim 1 further comprising a safety chain holder on the mounting clip.

14. The mobile sign rack of claim 1 further comprising a chain lift.

15. The mobile sign rack of claim 1 further comprising a spreader off-set assembly.

16. A mobile sign rack that can be easily and quickly mounted or disconnected from the tailgate of a vehicle for the purpose of storing and/or transporting signs, sign stands, traffic cones and stop and slow paddles to secure worksites on the roadway, comprising:

a. a substantially vertical frame attached to a base, wherein the vertical frame includes two front and two rear parallel disposed uprights, wherein the uprights are connected at the upper end by a pair of parallel disposed crossbars and a pair of horizontal stabilization bars, wherein the frame further includes an interior section for maintaining signage, wherein the interior section comprises at least one generally cylindrical tubular sign holder for storing flexible signage, wherein the generally cylindrical tubular sign holder includes a removable cap for accessing the interior of the sign holder;

b. at least one mounting clip for mounting the mobile sign rack to the vehicle;

c. at least one bumper assembly positioned on the frame for positioning the mobile sign rack on the vehicle, the at least one bumper assembly comprising means to maintain the mobile sign rack 10 in a substantially vertically oriented position;

d. a mounting tray attached to the base for storing traffic cones and other necessities, wherein the mounting tray includes a spacer bar and a foraminous floor;

e. a pair of leveling legs on the frame for positioning the mobile sign rack in a substantially level position when the mobile sign rack on a ground surface; and f. at least one pair of wheels 46 on the rack 10 to assist the mobility of the mobile sign rack when the mobile sign rack is positioned on a ground surface.

17. The mobile sign rack of claim 16 wherein the rear uprights comprise openings to allow for adjustment of the mounting clip along the length of the rear uprights.

18. The mobile sign rack of claim 17 wherein the position of the bumper assembly is adjustable along the frame by means of the openings in the rear uprights.

19. A mobile sign rack that can be easily and quickly mounted or disconnected from the tailgate of a vehicle for the purpose of storing and/or transporting signs, sign stands, traffic cones and stop and slow paddles to secure worksites on the roadway, comprising:

a. a substantially vertical frame attached to a base, wherein the vertical frame includes two front and two rear parallel disposed uprights, wherein the uprights are connected at the upper end by a pair of parallel disposed crossbars and a pair of horizontal stabilization bars, wherein the frame further includes an interior section for maintaining signage, wherein the interior section comprises at least one track for holding inflexible signage;

b. at least one mounting clip for mounting the mobile sign rack to the vehicle;

c. at least one bumper assembly positioned on the frame for positioning the mobile sign rack on the vehicle, the at least one bumper assembly comprising means to maintain the mobile sign rack in a substantially vertically oriented position;

d. a mounting tray attached to the base for storing traffic cones and other necessities, wherein the mounting tray includes a spacer bar and a foraminous floor;

e. a pair of leveling legs on the frame for positioning the mobile sign rack in a substantially level position when the mobile sign rack on a ground surface;

f. at least one pair of wheels on the mobile sign rack to assist the mobility of the mobile sign rack when the mobile sign rack is positioned on a ground surface; and g. brackets for holding traffic paddles.

* * * * *